US005390647A

United States Patent [19]

Schechter

[11] Patent Number: 5,390,647

[45] Date of Patent: Feb. 21, 1995

[54] AIR CHARGING VALVE FOR AN AIR FORCED FUEL INJECTOR

[75] Inventor: Michael M. Schechter, Farmington Hills, Mich.

[73] Assignee: Ford Motor Company, Dearborn, Mich.

[21] Appl. No.: 79,579

[22] Filed: Jun. 21, 1993

[51] Int. Cl.[6] ..... F02M 67/04

[52] U.S. Cl. ..... 123/532; 123/534

[58] Field of Search ..... 123/532, 534

[56] References Cited

U.S. PATENT DOCUMENTS

| | | | |
|---|---|---|---|
| 2,710,600 | 6/1955 | Nallinger | 123/533 |
| 4,693,224 | 9/1987 | McKay | 123/531 |
| 4,823,756 | 4/1989 | Ziejewski et al. | 123/531 |
| 4,892,065 | 1/1990 | List | 123/532 |
| 4,899,714 | 2/1990 | Schechter et al. | 123/533 |
| 4,944,277 | 7/1990 | Olson | 123/532 |
| 4,974,571 | 12/1990 | Oppenheim et al. | 123/532 |
| 5,025,769 | 6/1991 | Plohberger et al. | 123/532 |

FOREIGN PATENT DOCUMENTS 2195707 4/1988 United Kingdom .

*Primary Examiner*—David A. Okonsky

*Attorney, Agent, or Firm*—Roger L. May; Donald A. Wilkinson

[57] ABSTRACT

A air charging valve for use with a air forced fuel injection system. The charging valve admitting and storing compressed air from the engine cylinder and releasing it into the fuel injector to force out the air/fuel mixture into the engine cylinder. The charging valve will accept the pressurized air from the engine cylinder without allowing any air to escape back into the combustion chamber once it is in the air charging valve. The fuel injection system includes an injector having a fuel and air mixing chamber that includes a normally closed injector valve; the chamber being for premixing air and fuel before introduction of the compressed air which causes the fuel injection event.

11 Claims, 5 Drawing Sheets

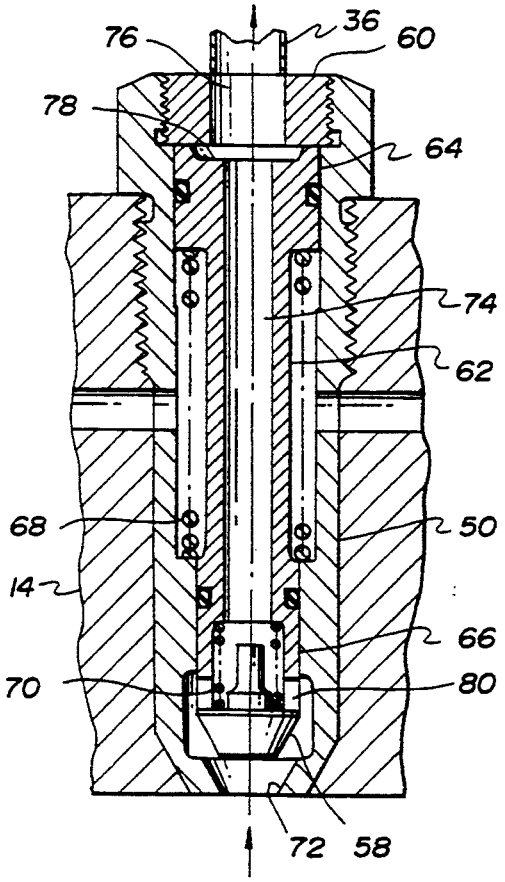
Fig. 5a
Fig. 5c
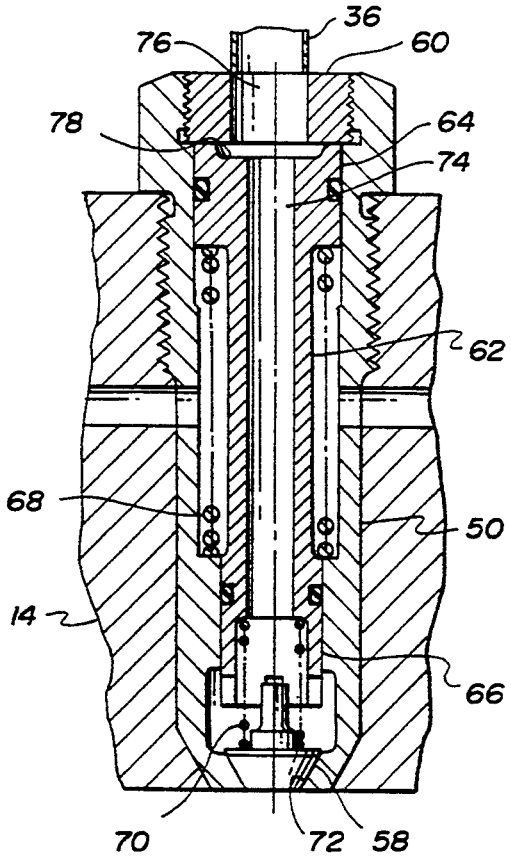
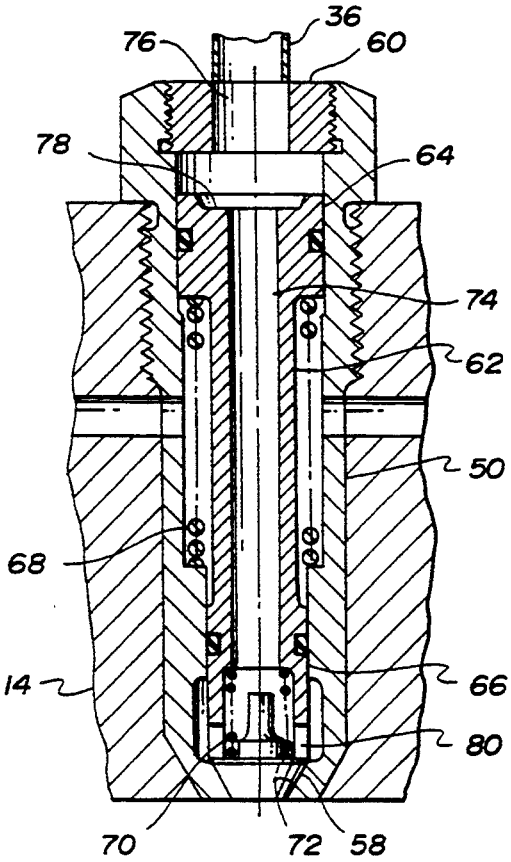
Fig. 5b

AIR CHARGING VALVE FOR AN AIR FORCED FUEL INJECTOR

TECHNICAL FIELD

This invention relates in general to a fuel injection system for an internal combustion engine. More particularly, it relates to a valve within an air forced fuel injector system.

BACKGROUND ART

Known in the art is a fuel injector construction that uses compressed air as the high pressure source for an injection event in a fuel injector, and in which air and fuel is premixed in the injector prior to injection. A typical fuel pump pressurizes the fuel. The air can be pressurized by using a separate compressor powered by the engine. Also, the air can be pressurized by using a charging valve that utilizes the pressure in the engine cylinder during the compression stroke to pressurize the air. In this type of injection system, the compressed air effects the opening of the fuel injector to discharge a fuel/air premixed mixture into the combustion chamber and is used for improved fuel atomization.

The charging valve is more efficient than a separate compressor since it does not need a separate power source to run the compressor. Additionally the charging valve does not need to have a location on the engine to mount the separate compressor. The charging valve takes little energy from the engine to operate since it merely draws a little pressure from the already pressurized engine cylinder. The need, then, exists for a charging valve that will compress and store a sufficient quantity of air to operate an air charged fuel injection system.

U.S. Pat. No. 4,899,714 to Schechter et al. discloses an air charging valve assembly capable of this. This charging valve will work within the forced air injection system to charge the air, without the need to have a separate compressor added to power the system. It has the capability to supply sufficient pressurized air for each injection event without overcharging the system. However, because this air charging valve opens outward into the cylinder, when the cylinder pressure drops during the expansion stroke, this residual pressure has a tendency to pull air with residual fuel from the charging valve back into the cylinder, which is detrimental to the overall engine emissions.

The need then arises for a charging valve that will compress sufficient air for use in the air forced injector each cycle without overcharging the system, by using cylinder compressed air as the charging pressure medium, but will not allow residual fuel to be pulled back into the engine cylinder from the charging valve.

DISCLOSURE OF INVENTION

The present invention contemplates an air charging valve for use with a compressorless air-forced fuel injector in combination with a cylinder in a four-stroke internal combustion engine. The charging valve includes a valve housing having a throughbore therethrough. It also includes a valve means within the throughbore for selectively accepting pressurized air into the throughbore from the engine cylinder when the pressure in the engine cylinder is above a predetermined minimum pressure. A reservoir means is connected to the housing for accepting the pressurized air from the throughbore and temporarily storing the pressurized air before it enters the air-forced fuel injector. Also, the charging valve has a piston-plunger means for selectively prohibiting the valve means from accepting pressurized air from the engine cylinder into the throughbore when the pressure in the reservoir means reaches a predetermined level and for preventing the discharge of pressurized air from within the throughbore back into the engine cylinder.

The present invention further contemplates a plurality of charging valves contained within an air-forced fuel injector system in combination with a multi-cylinder internal combustion engine.

Accordingly, it is an object of the present invention to employ an air charging valve to charge a forced air injection system, thereby eliminating the need for an engine driven air compressor to do the same job.

It is a further object of the present invention to employ an air charging valve to charge a forced air injection system while preventing the discharge of air from the air charging valve back into the engine cylinder to avoid drawing residual fuel contained within the air back into the engine cylinder, and thereby avoid a detrimental effect on the engine emissions.

Additionally, it is an object of the present invention to employ an air charging valve to be used in a forced air injection system without overcharging the system, while assuring that the required quantity of compressed air is available for the air-forced injection every cycle.

The foregoing and other objects, features and advantages of the present invention are readily apparent from the following detailed description of the best mode for carrying out the invention when taken in connection with the accompanying drawings. While the word "air" is used throughout, this is done for purposes of convenience and simplicity since it will be understood that the "air" is whatever air/gas is inducted into the engine prior to being mixed with fuel within the injectors.

BRIEF DESCRIPTION OF DRAWINGS

FIGS. 5*a*, 5*b*, and 5*c* are schematic views showing a single air charging valve, with the valve shown in three different stages of its operation, in accordance with the present invention;

BEST MODES FOR CARRYING OUT THE INVENTION

The present invention relates to air charging valves for air forced fuel injection systems used in internal combustion engines employing electronic devices for fuel and air control. To accomplish the injection of the air/fuel mixture from the injector into the engine cylinder, compressed air is supplied to the injector. To avoid the need for a separate engine driven compressor to accomplish the compression, the system employs a charging valve that supplies the compressed air needed to accomplish the fuel injection. The charging valve, then, will supply the compressed air needed for air forced fuel injection and for improved atomization of the fuel.

The compressed air is drawn from the engine cylinder during the compression stroke and briefly stored in a reservoir until discharged into the air forced injector. The injection occurs when the air control solenoid is activated for fuel injection in the next engine cycle. This, then, eliminates the need for an engine driven compressor to charge the air. The charging valve of the present invention will charge without overcharging the system, assure that the required quantity of air is available for air-forced injection every cycle, and prevent discharge of air back into the engine cylinder from the charging valve to avoid drawing residual fuel back into the engine cylinder.

Figure 1:
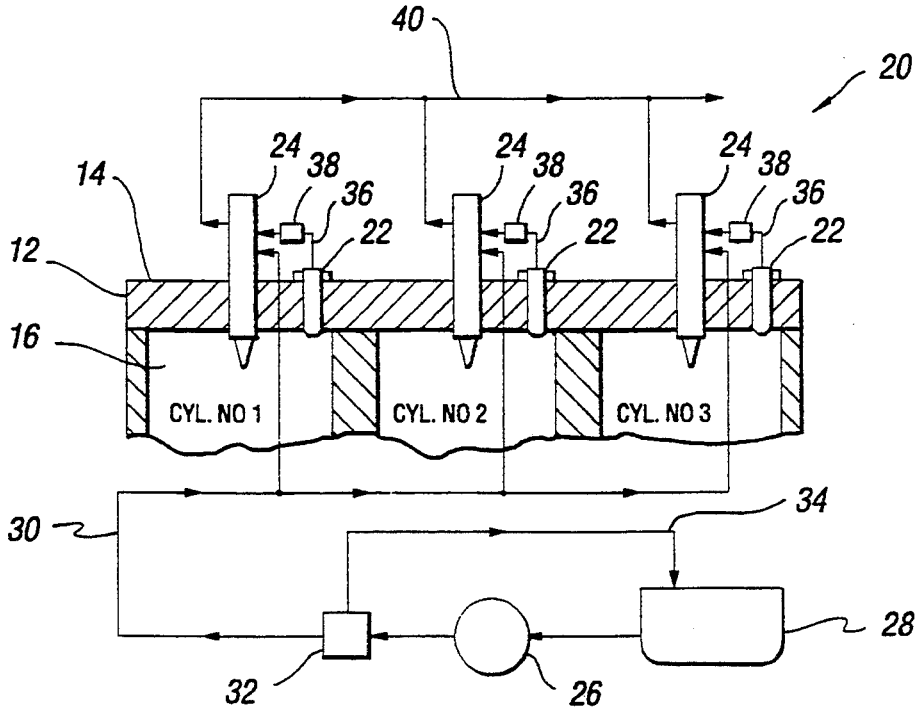
FIG. 1 is a schematic illustration of a fuel injection system in accordance with the present invention.

FIG. 1 illustrates a forced air injection system 20 employing charging valves 22 for a three cylinder engine 12. The system 20 will work equally well with any known internal combustion engine configuration including any number of cylinders. Installed in the cylinder head 14 are a fuel injector 24 and a corresponding charging valve 22 associated with each of the cylinders 16. The fuel and compressed air is supplied to the fuel injectors 24 by two separate sub-systems. In the fuel supply sub-system, a fuel pump 26 draws fuel from a fuel reservoir 28 and delivers it under pressure to a common fuel rail 30 connected to all three injectors 24. The fuel passes through a fuel pressure regulator 32 that returns excess fuel via excess fuel return line 34 to the reservoir 28 if this sub-system has excess pressure.

In the compressed air supply sub-system, an air line 36 from one of the charging valves 22, described in connection with FIG. 3, connects each injector with its corresponding charging valve 22. In a given cylinder 16, its associated injector 24 is connected with the charging valve 22 installed in the same cylinder 16. This arrangement minimizes the distance the compressed air must travel between the charging valve 22 and its corresponding fuel injector 24, thereby minimizing heat loss from the compressed air before it enters the fuel injector 24. The higher temperature air increases the evaporation of the fuel before it enters the engine cylinder 16.

Connected between each charging valve 22 and its corresponding injector 24 is a compressed air reservoir 38 that temporarily stores the compressed air before being released into the injector 24. In the most elementary case, the compressed air supply system would simply consist of the air lines 36 connecting each associated charging valve 22 with its corresponding injector 24. This works provided each line 36 has the capacity to hold enough compressed air needed for the next fuel injection event. The air vented from all the injectors 24 is returned to an engine intake via a vented air return line 40.

Figure 2:
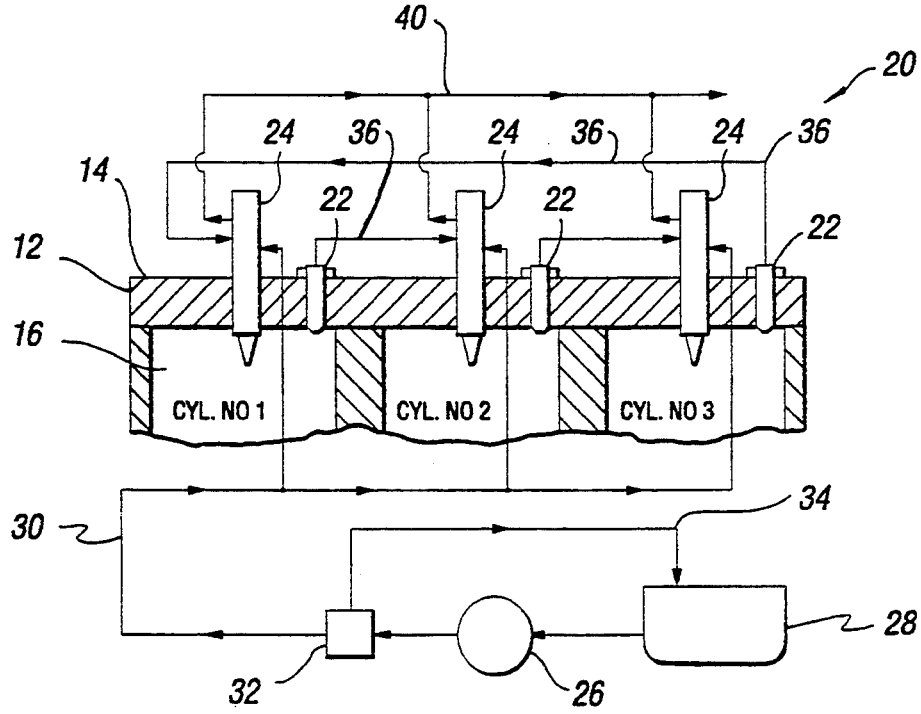
FIG. 2 is a schematic illustration of an alternate embodiment of the fuel injection system in accordance with the present invention.

An alternate embodiment of the forced air injection system is illustrated in FIG. 2. In this embodiment, the fuel supply sub-system is configured the same as in the first embodiment; however, the connections between the air charging valves 22 and the fuel injectors 24 are configured differently. In a given engine cylinder 16, the injector 24 is connected with the charging valve 22 installed in the cylinder 16 preceding the given cylinder 16 in the engine firing order. For this configuration, since the compressed air lines 36 are longer than in the first embodiment, the volume of each line 36 is sufficient to store enough compressed air to perform at least one fuel injection event. Thus, the lines 36 themselves are used as the compressed air reservoirs.

Figure 2A:
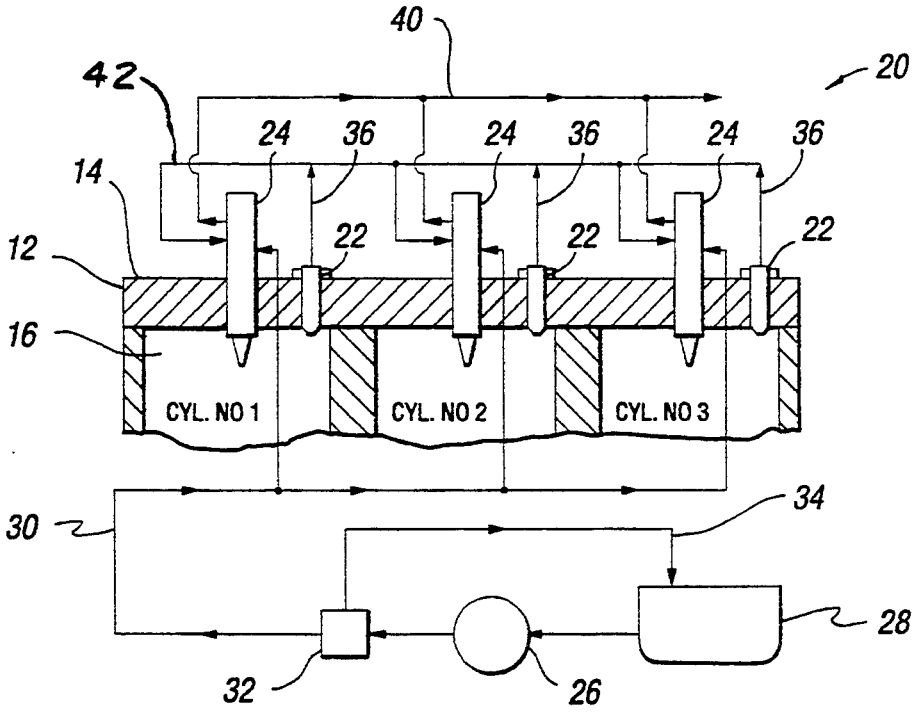
FIG. 2*a* is a schematic illustration of another alternate embodiment of the fuel injection system in accordance with the present invention.

Another alternate configuration shown in FIG. 2*a*, has a common rail 42 between the charging valves 22 and fuel injectors 24 that acts as a single reservoir for the compressed air waiting to be used in the injectors 24.

Figure 3:
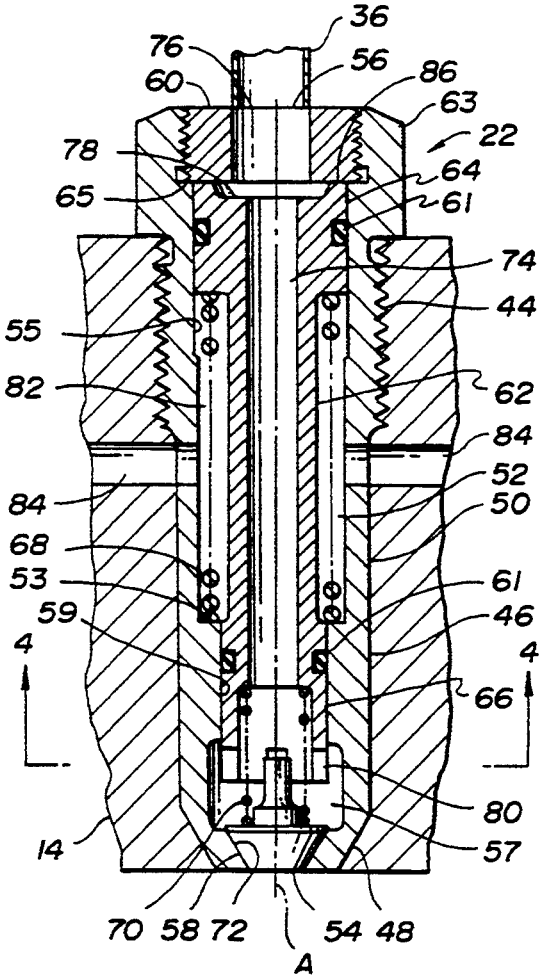
FIG. 3 is a cross-sectional view of an air charging valve in accordance with the present invention.
Figure 4:
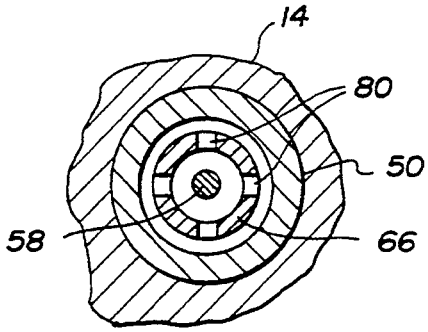
FIG. 4 is a cross-sectional view taken along lines 4—4 in FIG. 3.

FIGS. 3 and 4 show an air charging valve assembly 22 for use in the forced air injection systems 20 as illustrated in FIGS. 1, 2 and 2*a*. The purpose of each charging valve 22 is to tap the pressure generated in the engine cylinder 16 during a compression stroke and charge the compressed air supply sub-system to the predetermined maximum pressure.

The valve assembly 22 includes a valve housing 50 having a threaded head portion 44, a cylindrical body portion 46, and an externally tapered nose portion 48 that firmly locates the assembly 22 within the correspondingly tapered receiving bore of the cylinder head, and an internal cavity or throughbore 52. Throughbore 52 is counterbored at both ends to provide a spring stop shoulder 53 and a finished piston cylinder wall portion 55 at one end and a cavity 57 at its other end. The remainder of throughbore 52 provides a guide cylinder wall portion 59 for the plunger portion 66 of the piston-plunger member 62 described below. The throughbore 52 has an inlet at a first end 54 of the housing 50 and an outlet at a second end 56 of the housing 50. Located at the first end 54 and contained within the throughbore 52 is an inlet valve 58. Located at the second end 56 is a stop member 60, mounted to the housing 50. Between the inlet valve 58 and the stop member 60, within the throughbore 52, is a central slidable piston-plunger member 62. The member 62 is comprised of a piston portion 64 and a plunger portion 66, integral with the piston portion 64. Each portion includes an O-ring or other sealing member located within a respective annular recess 61. A first compression spring 68, retained between the valve housing 50 and the central member 62, biases the central member 62 against the stop member 60. A second small compression spring 70 biases the inlet valve 58 closed by pressing it against a valve seat 72 at the first end 54 of the housing 50.

A central bore 74 extends longitudinally through the central member 62 along its axis "A" and aligns with an outlet bore 76 through the stop member 60. The piston 64 has a counter-bore 78, concentric about the central bore 74, located on the outlet end of the piston 64. The counter-bore 78 has a larger diameter than the plunger 66. The difference in diameters between the counterbore 78 and the plunger 66 determines the initial area upon which the air pressure will act on the piston-plunger member 62. This initial pressure area multiplied by the pressure in the air line 36 is the force that counteracts the force of the first spring 68 while the member 62 abuts the stop member 60. The stop member 60 is threadably received within nut member 63, which holds the charging valve assembly 22 fixed within the cylinder head. Stop member 60 abuts an internal shoulder 65 of the nut member 63.

The end of the plunger 66 facing the first end 54 of the housing 50 has two slots or air passages 80. The passages 80 allow air to pass by the inlet valve 58 and into the central bore 74 even when the inlet valve 58 presses against the plunger 66. The air charging valve 22 mounts within the cylinder head 14 such that the inlet valve 58 is exposed to the combustion chamber pressure in the cylinder 16; and the nut 63, including outlet bore 76, protrudes from the cylinder head 14 to connect to air line 36 leading to compressed air reservoir 38. A first spring chamber 82 connects to a passage 84 in the cylinder head 14 vented to an intake manifold.

FIGS. 5*a* to 5*c* show the operation of the air charging valve when operating in the forced air injection system illustrated in FIGS. 1, 2 and 2*a*. During the compression stroke within the engine cylinder 16, rising air pressure in the cylinder acting on the exposed area of the inlet valve 58 exceeds the counteracting force from the second small spring 70. This pressure lifts the inlet valve 58 from the valve seat 72 until it abuts the plunger 66. Air then flows from the engine cylinder 16, through flow passage 80 and into the central bore 74 of the central member 62, and from there out of the outlet bore 76 into the compressed air line 36 where the pressure begins to increase (FIG. 5*a*).

Since the initial pressure area of the piston 64 exposed to the air pressure from the air line 36 is larger than the area of the plunger 66 at its inlet end exposed to the cylinder air pressure, there is a net pressure force acting against the bias of the first spring 68 on the central member 62. This net pressure force increases with an increase in air pressure in the air line 36. When the net pressure force due to this pressure difference exceeds the pre-load of the first spring 68, the piston 64 begins to move away from the stop member 60. As it moves away from the stop member 60, additional area of the piston 64, namely, its outer annular rim portion 86, becomes exposed to the air pressure from the air line 36. There is, thus, an increase in area of the piston 64 exposed to the pressure in the air line 36 and consequently a sudden increase in the net downward pressure force. For example, the total piston area relative to the counterbore 78 area may be in the order of 1.5:1. The central member 62, then, moves away from the stop member 60, forcibly closing the inlet valve 58 and terminating the charging of the air reservoir 38 or air line 36 (FIG. 5*b*).

This increase in downward pressure force is designed to be large enough to keep the inlet valve 58 closed during combustion in engine cylinder 16. Thus, the charging valve 22 is designed such that the total piston head area upon which the pressure is acting provides sufficient force to hold the inlet valve 58 closed even during combustion in engine cylinder 16.

For example, in an engine with a maximum combustion pressure of approximately 50 bars, a forced air injector 24 that operates on 12.5 bars pressure, and a first spring 68 having a spring force of 42 newtons, a piston-plunger 62 with a net area of approximately 96 millimeters squared or more could hold the inlet valve 58, having an area of pressure of approximately 10 millimeters squared or less, closed during a cylinder combustion event. The spring rate of the second spring 70 is not very strong and can be of an order of magnitude less than the first spring 68.

Only when the air discharges from the reservoir 38 during the next cycle of air forced fuel injection, will the pressure in the charging valve 22 drop. This drop will allow the first spring 68 to return the central member 62 to its position abutting the stop member 60 (FIG. 5*c*). After that, the inlet valve 58 again opens during the next compression stroke within that cylinder and the air reservoir 38 or air line 36 recharges and is again ready to charge a fuel injector 24 within the injection system.

Figure 6:
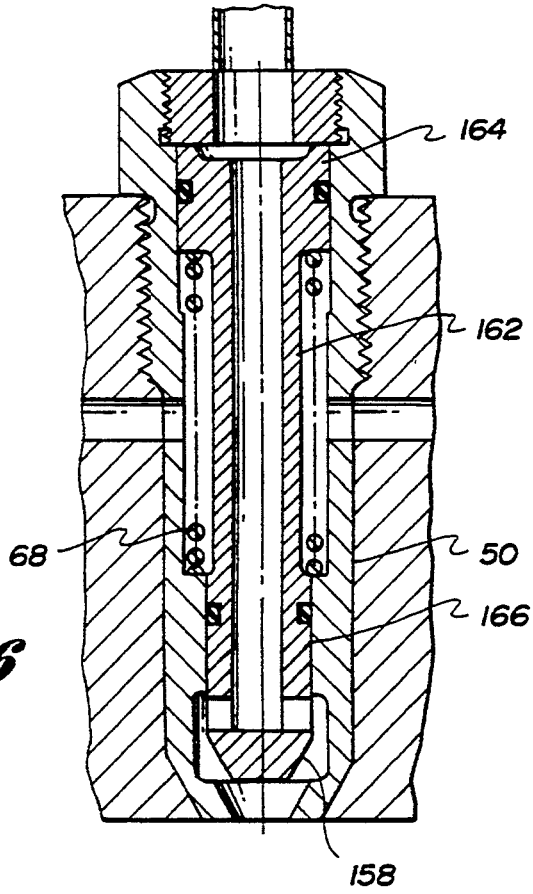
FIG. 6 is a cross-sectional view of an alternate embodiment of the air charging valve in accordance with the present invention.

An alternate embodiment of the air charging valve is illustrated in FIG. 6. In this embodiment, instead of having a separate inlet valve 58 and central member 62 with the second spring 70 biasing them apart, the central member 162 includes a piston portion 164, a plunger portion 166 and also an integral inlet valve portion 158. This configuration eliminates the need for the separate second spring. The central member 162, then, moves as an integral unit through the inlet valve opening and closing cycles when supplying compressed air for the air forced fuel injector system.

Figure 7:
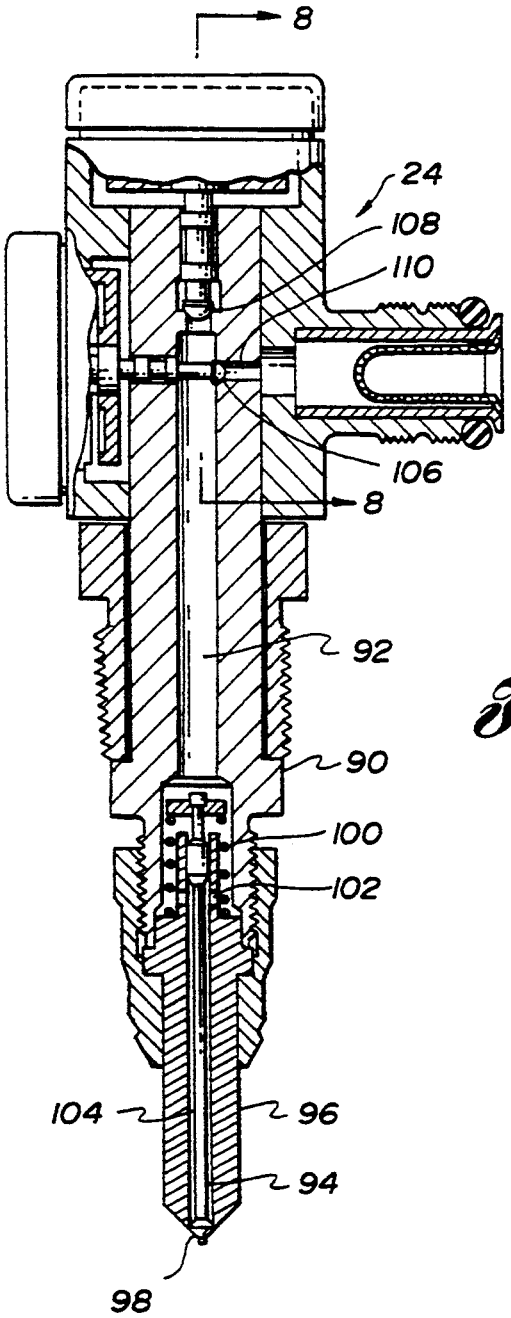
Fig. 7 (Prior Art)
FIG. 7 is cross-sectional schematic view of a fuel injector assembly known in the prior art but applicable for use with the injector system of the present invention.
Figure 8:
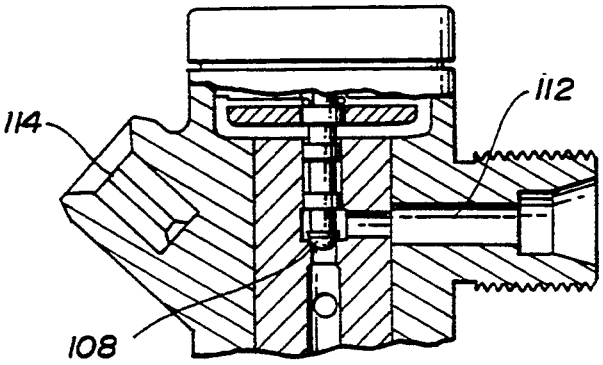
Fig. 8 (Prior Art)
FIG. 8 is cross-sectional view taken along lines 8—8 in FIG. 7.

FIGS. 7 and 8 illustrate an injector assembly 24 that can be operated using compressed charging air as received from the charging valve 22 of the present invention. A main feature of the injection system that employs this air charging valve 22 is that an interval separates fuel charge metering and fuel air charge injection during which the fuel charge is in contact with the charged air and can begin to evaporate. Thus, when it is injected into the engine cylinder 16 by the compressed air charge, a premixed fuel/air charge is injected with the fuel at least partially in the gaseous state.

The fuel injector 24 includes an injector housing 90 containing a central air/gas fuel mixing chamber 92. The chamber extends longitudinally along the axis of the injector assembly 24 and contains a fuel injector valve 94. The valve 94 reciprocates in a valve body 96 between open and closed positions, and has a nozzle or tip 98 seated against the body 96 by a spring 100. Side ports 102 communicate the fuel/air mixture charge in the mixing chamber 92 to the tip 98 of the injector valve 94 along the channel or passage 104 containing the stem of the valve 94.

The part of the mixing chamber 92 opposite the fuel injector valve 94 is closed off by a pair of normally closed, solenoid actuated poppet type valves 106 and 108. Solenoid valve 106 is a fuel control valve. It normally closes a supply passage 110 communicating with the mixing chamber 92 at one end and with the fuel supply 30 at its other end. Solenoid valve 108 is an air control valve. It normally blocks the passage of compressed air from a passage 112 connected to the compressed air reservoir 38 or air line 36 into the mixing chamber 92. FIG. 8 also shows an electrical input 114 to both the fuel 106 and air 108 solenoids for activating them.

The mixing chamber 92 always contains air. For this purpose, the mixing chamber 92 vents to the outside, when the solenoid valve 108 is closed, so that its residual pressure always drops to a low level after the end of fuel injection, approximately equal to atmospheric pressure.

The solenoids 106, 108 are controlled by an electronic control system that supplies the solenoids with voltage signals of variable width and timing. The signals are fed through the connector 114. When the fuel valve 106 opens, fuel will be metered into the mixing chamber 92. The metered fuel quantity is determined by the duration of fuel control valve opening, the size of the orifice and the supply of fuel pressure. Usually, it is controlled by controlling the solenoid pulse width. After the introduction of the fuel into the chamber 92, the fuel stays in the air filled chamber 92 for a substantial portion of an engine cycle. This provides an interval in which the fuel is exposed to the air and can evaporate before the mixture is injected into the engine. It permits time for the fuel vapor to mix with the air in the chamber.

Thus, when the air control valve 108 opens, a charge of compressed air fills the mixing chamber 92 to effect a further mixing and evaporation of the fuel by a penetration of the air into the fuel, and opens the normally closed injector valve 94 to expel the premixed fuel/air charge past the valve tip 98. This is the fuel injection event or cycle. The timing of fuel injection can be controlled by controlling the timing of the air control solenoid pulse. Varying the compressed air pressure also can vary injection rate and fuel penetration. The fuel injection ends when the air control solenoid or actuator deactivates and the air control valve 108 closes thereby completing a fuel injection cycle.

While the best mode for carrying out the invention has been described in detail, those familiar with the art to which this invention relates will recognize various alternate designs and embodiments for practicing the invention as defined by the following claims.

I claim:

1. An air charging valve for use with a compressorless air-forced fuel injector in combination with a cylinder in a four-stroke internal combustion engine, the air charging valve comprising:

a valve housing having an internal throughbore therethrough, the throughbore having a first end exposed to the engine cylinder and a second end spaced from the first end;

valve means within the throughbore for selectively accepting pressurized air through the first end of the throughbore from the engine cylinder when the pressure in the engine cylinder is above a predetermined minimum pressure;

reservoir means for accepting the pressurized air from the second end of the throughbore and temporarily storing the pressurized air before it enters the air-forced fuel injector; and piston-plunger means for selectively prohibiting the valve means from accepting pressurized air from the engine cylinder into the throughbore when the pressure in the reservoir means reaches a predetermined level and for preventing the discharge of pressurized air from within the throughbore back into the engine cylinder.

2. An air charging valve according to claim 1 wherein the valve housing includes a stop at the second end of the throughbore; and the piston-plunger means comprises a piston and a plunger integral with the piston, which is slidingly received within the throughbore and contained between the valve means and the stop, and a first spring biasing the plunger away from the valve means towards the stop, to thereby allow the valve means to open and prohibit the valve means from opening when the pressure in the reservoir means reaches a predetermined level.

3. An air charging valve according to claim 2 wherein the valve housing includes a valve seat at the first end of the throughbore; and the valve means comprises an inlet valve, slidably received within the throughbore, and a second spring which biases the inlet valve in a closed position against the valve seat, the valve seat only allowing the inlet valve to open inwardly into the throughbore.

4. The air charging valve of claim 3 wherein the inlet valve includes a pressure area exposed to the engine and the piston includes a pressure area exposed to the reservoir means that is sufficiently larger than the pressure area on the inlet valve whereby the piston and plunger will hold the inlet valve closed during combustion when the reservoir means is at its predetermined pressure level.

5. An air charging valve according to claim 1 wherein the valve housing includes a valve seat at the first end of the throughbore; and the valve means comprises an inlet valve, slidably received within the throughbore, and a second spring which biases the inlet valve in a closed position against the valve seat, the valve seat only allowing the inlet valve to open inwardly into the throughbore.

6. An air charging valve according to claim 1 wherein the valve means comprises an inlet valve slidingly received within the throughbore, and the piston-plunger means comprises an integral piston and plunger slidingly received within the throughbore of the housing, the integral piston and plunger also integral with the inlet valve.

7. An air forced fuel injector assembly for use with a cylinder within an internal combustion engine comprising:

a fuel injector body having an air inlet, a fuel inlet, a mixing chamber, and an actuable normally closed fuel/air outlet;

means connecting the air inlet to a source of air under pressure;

means connecting the fuel inlet to a source of fuel under pressure for mixing with the air in the mixing chamber;

a compressed air reservoir coupled to the fuel injector air inlet;

air charging valve means for charging the compressed air reservoir with pressurized air from the engine cylinder while preventing the return of air from the valve means back into the engine cylinder the air charging valve means comprises a valve housing mounted to the engine, the housing having an inlet open to the engine cylinder, an outlet connected to the fuel injector assembly air inlet and an internal throughbore connecting the inlet to the outlet; the air charging valve means further comprising an inlet valve mounted within the throughbore that opens inward into the throughbore, and a piston-plunger means for selectively preventing the inlet valve from accepting pressurized air from the engine cylinder into the throughbore when the air pressure in the compressed air reservoir reaches a predetermined level and for preventing the discharge of pressurized air from within the throughbore of the valve housing back into the engine cylinder.

8. An injector assembly according to claim 7 wherein the valve housing includes a stop mounted to the outlet and a valve seat formed around the inlet; the air charging valve has a first spring biasing the piston-plunger means against the stop; and the air charging valve means has a second weaker spring biasing the inlet valve against the valve seat.

9. A fuel injection system for use with a plurality of cylinders in an internal combustion engine comprising:

a plurality of air forced fuel injectors that are individually sequentially operable, each injector having a fuel/air mixing chamber with fuel and air inlets thereto and a mixture outlet therefrom normally blocked by a spring-closed-pressure-opened valve;

a source of fuel under pressure coupled to the fuel inlets;

at least one compressed air reservoir coupled to the air inlets of the fuel injectors;

air charging valve means for providing a source of air under pressure to the at least one reservoir from the engine cylinders while preventing the return of gas from the charging valve means back into the engine cylinders;

means venting the mixing chamber to ambient pressure prior to the inlet of fuel thereto;

first solenoid control means connecting the fuel source to each injector air inlet; and electrically operated means controlling the energization of the solenoid means to selectively apply the fuel and air to each injector in a manner providing a delay between introduction of the fuel into the injector and introduction of the air under pressure.

10. A fuel injector system according to claim 9 wherein the air charging valve means comprises a plurality of air charging valves, each associated with one corresponding engine cylinder and each providing the source of air under pressure to the fuel injector associated with its corresponding cylinder.

11. A fuel injector system according to claim 9 wherein the air charging valve means comprises a valve housing mounted to the engine, the housing having an inlet open to the engine cylinder, an outlet connected to the compressed air reservoir and a throughbore connecting the inlet to the outlet; the air charging valve means further comprising an inlet valve mounted within the throughbore that opens inward into the throughbore, and a piston-plunger means for selectively preventing the inlet valve from accepting pressurized air from the engine cylinder into the throughbore when the air pressure in the compressed air reservoir reaches a predetermined level and for preventing the discharge of pressurized air from within the throughbore of the valve housing back into the engine cylinder.

* * * * *